US009048561B2

(12) United States Patent
Nakamura et al.

(10) Patent No.: US 9,048,561 B2
(45) Date of Patent: Jun. 2, 2015

(54) WATERPROOF STRUCTURE FOR CONNECTOR

(71) Applicant: Yazaki Corporation, Minato-ku, Tokyo (JP)

(72) Inventors: Koichi Nakamura, Kakegawa (JP); Yuji Arita, Kakegawa (JP); Toru Suzuki, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/195,969

(22) Filed: Mar. 4, 2014

(65) Prior Publication Data

US 2014/0248793 A1 Sep. 4, 2014

(30) Foreign Application Priority Data

Mar. 1, 2013 (JP) ..... 2013-040430

(51) Int. Cl.

| | |
|---|---|
| ***H01R 13/40*** | (2006.01) |
| ***H01R 13/52*** | (2006.01) |
| ***H01R 13/424*** | (2006.01) |
| ***H01R 13/6582*** | (2011.01) |
| ***H01R 9/03*** | (2006.01) |
| *H01R 13/6581* | (2011.01) |

(52) U.S. Cl.

CPC ..... *H01R 13/52* (2013.01); *H01R 13/424* (2013.01); *H01R 13/6582* (2013.01); *H01R 9/032* (2013.01); *H01R 13/5205* (2013.01); *H01R 13/6581* (2013.01)

(58) Field of Classification Search

CPC . H01R 13/65802; H01R 13/424; H01R 9/032
USPC ..... 439/519, 271, 607.18, 607.41, 589, 587
See application file for complete search history.

(56) References Cited

U.S. PATENT DOCUMENTS

| | | | | |
|---|---|---|---|---|
| 5,709,569 | A * | 1/1998 | Buck et al. | 439/607.01 |
| 6,583,352 | B2 * | 6/2003 | Fukushima et al. | 174/373 |
| 6,802,740 | B1 * | 10/2004 | Fan et al. | 439/607.04 |
| 7,594,821 | B1 * | 9/2009 | Hasija et al. | 439/271 |
| 7,628,650 | B2 * | 12/2009 | Aoki et al. | 439/607.28 |
| 2010/0261365 | A1 * | 10/2010 | Sakakura | 439/271 |

FOREIGN PATENT DOCUMENTS

| | | | |
|---|---|---|---|
| JP | 2011-70848 | A | 4/2011 |
| WO | 2011/037269 | A1 | 3/2011 |

* cited by examiner

*Primary Examiner* — Neil Abrams
*Assistant Examiner* — Travis Chambers
(74) *Attorney, Agent, or Firm* — Sughrue Mion, PLLC

(57) ABSTRACT

A waterproof structure for a connector includes a housing, a shield wire, a shield terminal, a first packing, and a second packing. The housing has a tubular housing part. The shield wire passes through the inside of the tubular housing part and extends from the housing. The shield terminal has a first section, a second section and a third section. The first section and the second section get into the tubular housing part such that the shield wire passes through the inside of the shield terminal, the first section joints with a braided shield wire of the shield wire, and the third section protrudes from the tubular housing part. The first packing seals a gap between the second section of the shield terminal and the tubular housing part. The second packing seals a gap between the shield wire and the third section of the shield terminal.

2 Claims, 5 Drawing Sheets

WATERPROOF STRUCTURE FOR CONNECTOR

CROSS REFERENCE TO RELATED APPLICATION

This application claims benefit of priority under 35 U.S.C. §119 to Japanese Patent Application No. 2013-040430, filed on Mar. 1, 2013, the entire contents of which are incorporated by reference herein.

BACKGROUND OF THE INVENTION

1. Field of the Invention

The present invention relates to a waterproof structure for a connector and particularly to a waterproof structure for a connector to which a shield wire is connected.

2. Description of the Related Art

Japanese Patent Application Laid-Open Publication 2011-70848 discloses a conventional connector waterproof structure 201 shown in FIG. 1.

In order to seal a joint portion 207 of a braided shield wire 211 of a shield wire 209 and a shield terminal 213, the connector waterproof structure 201 has a sealing packing 203 installed from one end of the shield wire 209 in the extending direction thereof and a sealing cap 205 installed from the other end of the shield wire 209 in the same.

However, since the sealing cap 205 of the conventional connector waterproof structure 201 has a hollow structure, there is a problem of low waterproof performance. Moreover, since the conventional connector waterproof structure 201 has the joint portion 207 sealed from both ends of the shield wire 209 in the extending direction thereof, there is another problem of an increased sealing length (sealing structure).

SUMMARY OF THE INVENTION

In view of the above problems, the present invention has an object to provide a waterproof structure for a connector with high waterproof performance and a reduced sealing length.

According to a first aspect of the present invention, there is provided a waterproof structure for a connector, including: a housing that has a tubular housing part; a shield wire that has one end thereof getting into the housing through the tubular housing part and the other end thereof extending from the housing; a shield terminal that has a first section, a second section, and a third section, the first section and the second section getting into the tubular housing part such that the shield wire passes through the inside of the shield terminal, the first section jointing with a braided shield wire of the shield wire, and the third section protruding from the tubular housing part; a tubular first packing that fits tightly around the second section of the shield terminal such that the second section of the shield terminal gets into the inside of the first packing, and fits tightly to the tubular housing part such that the first packing gets into the inside of the tubular housing part; and a tubular second packing that fits tightly to the third section of the shield terminal such that the second packing gets into the inside of the third section of the shield terminal, and fits tightly around the shield wire such that the shield wire passes through the inside of the second packing.

According to a second aspect of the present invention, the waterproof structure for a connector, further including a shield shell that has a tubular shield shell part, wherein the tubular housing part and the shield terminal get into the inside of the tubular shield shell, the shield shell is mounted on the housing such that the shield wire passes through the inside of the tubular shield shell, and the third section of the shield terminal is supported by the tubular shield shell.

The present invention provides a waterproof structure for a connector with high waterproof performance and a reduced sealing length.

DESCRIPTION OF THE EMBODIMENTS

A connector 3 that employs a connector waterproof structure 1 (terminal sealing structure) according to an exemplary embodiment of the present invention is, for example, a high-voltage AC connector which is to be installed and used in a vehicle inverter.

In the connector 3, a predetermined direction is defined as a longitudinal direction, a predetermined direction orthogonal to the longitudinal direction is defined as a vertical direction, and a predetermined direction orthogonal to the longitudinal direction and the vertical direction is defined as a lateral direction for convenience of the following description.

Figure 2:
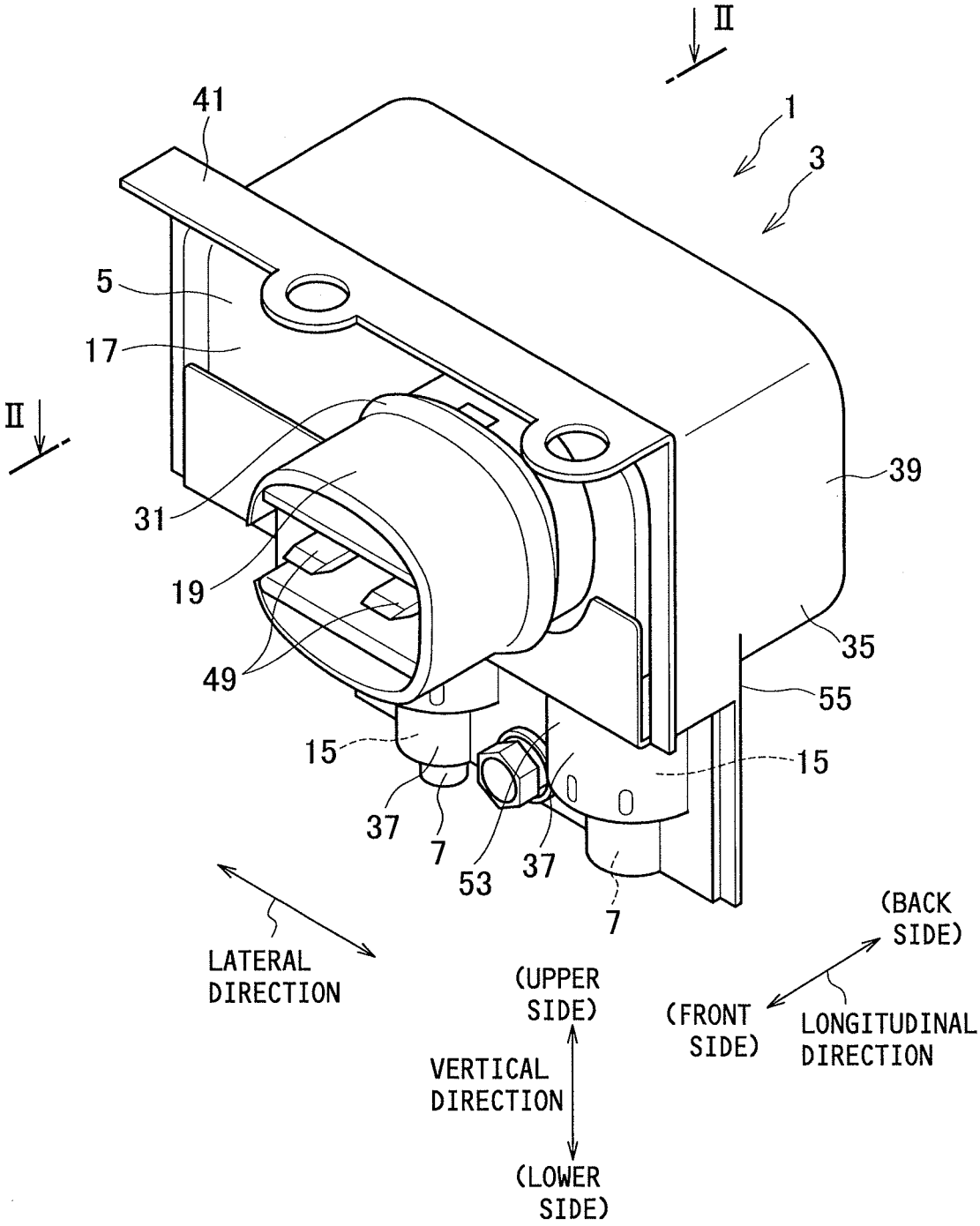
FIG. 2 is a perspective view of a connector which employs a waterproof structure for a connector according to an exemplary embodiment of the present invention.
Figure 3:
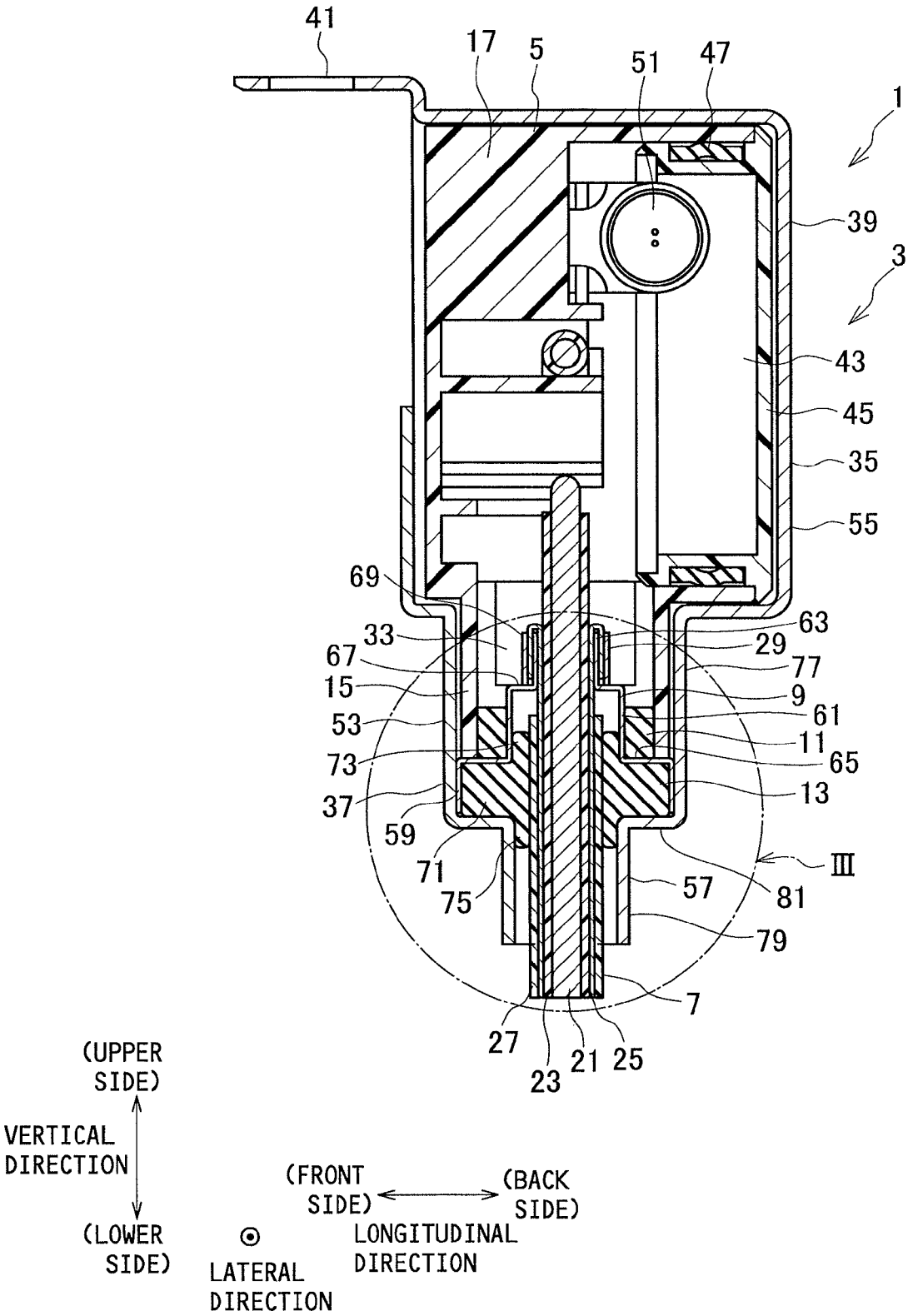
FIG. 3 is a cross-sectional view of the connector taken along a line II-II in FIG. 2.
Figure 4:
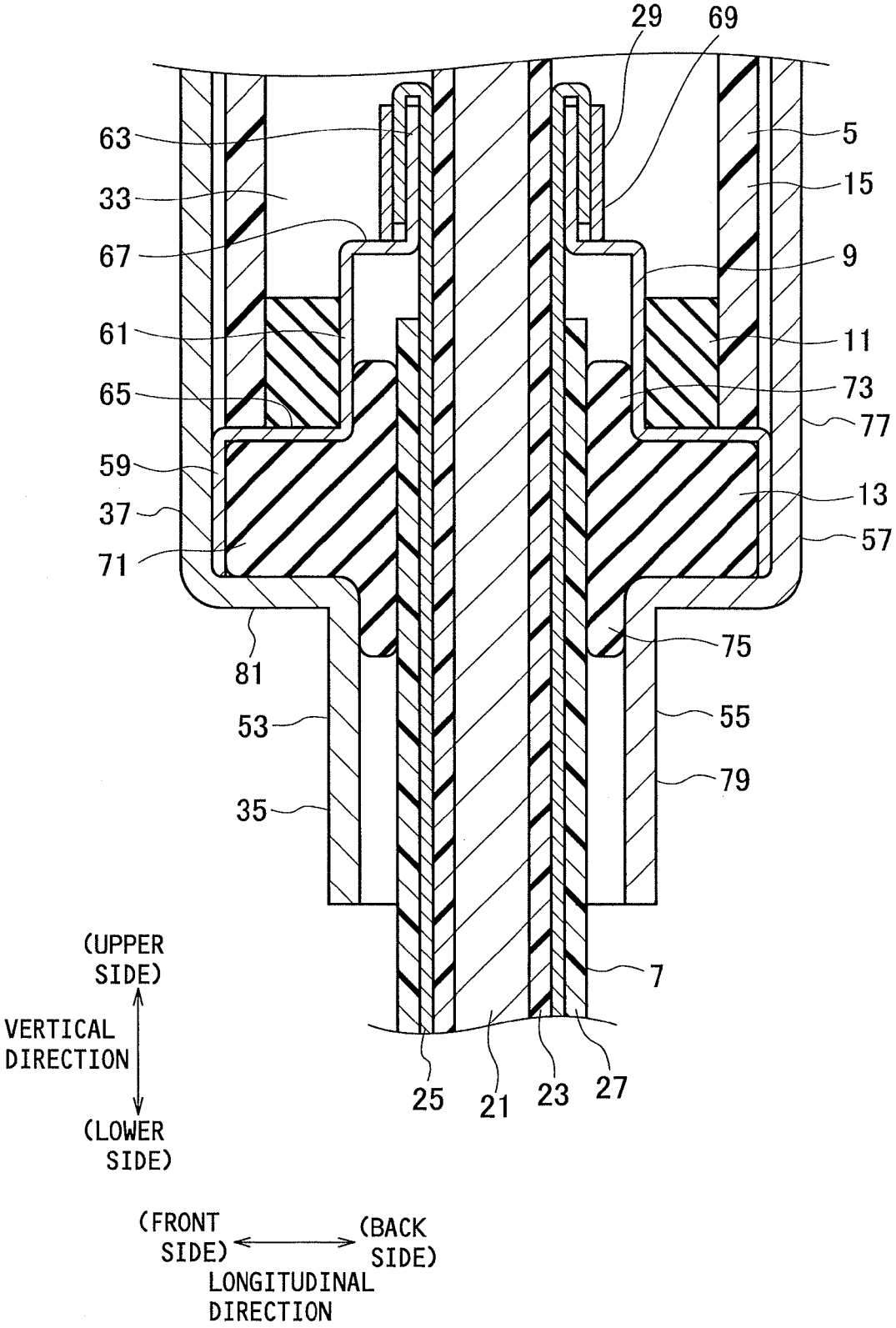
FIG. 4 is an enlarged view of a part III in FIG. 3.

As shown in FIGS. 2 to 4, the connector waterproof structure 1 includes a housing 5, shield wires 7 and 7, shield terminals 9 and 9, first packings 11 and 11, and second packings 13 and 13. It is noted that the drawings illustrate one shield terminal 9, one first packing 11 and one second packing 13.

The housing 5 is made of, for example, an insulating synthetic resin, and includes tubular housing parts 15 and 15, a housing body part 17, and an apparatus engagement part 19.

The apparatus engagement part 19 is provided on the front upper part of the housing body part 17. When the connector 3 is installed in an apparatus such as an inverter, the apparatus engagement part 19 is engaged with the apparatus. The tubular housing parts 15 and 15 protrude downward from the back lower part of the housing body part 17. The extending direction of the axis (central axis) of each tubular housing part 15 corresponds to the vertical direction. Each tubular housing part 15 has a cylindrical space formed therein.

Each shield wire 7 includes a core wire 21, an inner covering body 23, a braided shield wire 25, and an outer covering body 27, and is formed, for example, in an elongated cylindrical shape. The core wire 21 is configured of conducting wires made of metal or the like. The inner covering body 23 is made of an insulating synthetic resin and covers the core wire 21. The braided shield wire 25 is formed in a tubular shape by braiding metal wires which are made of metal or the like, and covers the inner covering body 23. The outer covering body 27 is made of an insulating synthetic resin and covers the braided shield wire 25.

Each shield wire 7 has one end part (upper end part) in the axial extending direction thereof, which gets into the housing 5. At the upper end part of the shield wire 7, the outer covering body 27 and the braided shield wire 25 are removed such that the core wire 21 and the inner covering body 23 are exposed. At a part on the other end (lower part) of the shield wire 7 in the axial extending direction thereof, the core wire 21, the inner covering body 23, the braided shield wire 25, and the outer covering body 27 passes through the inside of the tubular housing part 15 so as to extend from the housing 5.

Each shield wire 7 extends in the vertical direction, and the axis of the corresponding tubular housing part 15 corresponds to that (central axis) of the shield wire 7.

Each shield terminal 9 is formed of a conductive material such as metal in a tubular shape. The shield terminal 9 has the corresponding shield wire 7 passing through the inside thereof, and includes a first section (upper end part), a second section (middle part), and a third section (lower end part) in the extending direction of the axis (central axis) thereof. The first section and the second section get into the inside of the corresponding tubular housing part 15. The first section joints with the braided shield wire 25 of the corresponding shield wire 7. The third section protrudes downward from the corresponding tubular housing part 15. The protruding length of the shield terminal 9 from the corresponding tubular housing part 15 is shorter than that of the corresponding shield wire 7.

The axial extending direction of the shield terminal 9 which has a tubular shape corresponds to the vertical direction. The central axis of the corresponding shield wire 7 nearly corresponds to that of the shield terminal 9.

The upper end of the third section of the shield terminal 9, which protrudes from the corresponding tubular housing part 15, abuts on the lower end (tip) of the corresponding tubular housing part 15. Thereby it is possible to prevent the shield terminal 9 from moving upward. That is, the shield terminal 9 is prevented from moving to the one end side in the axial extending direction thereof by the lower end of the corresponding tubular housing part 15.

Each first packing 11 is formed of a non-conductive (insulating) material such as rubber in a tubular shape. The first packing 11 fits tightly around the second section of the corresponding shield terminal 9 in the axial extending direction of the corresponding shield terminal 9 such that the second section gets into the inside of the first packing 11. The first packing 11 also fits tightly to the corresponding tubular housing part 15 such that the first packing 11 gets into the inside of the corresponding tubular housing part 15.

The extending direction of the axis (central axis) of the first packing 11 corresponds to the vertical direction. The central axis of the corresponding shield wire 7 nearly corresponds to that of the first packing 11. The internal circumference of the first packing 11 contacts with the second section (middle part in the vertical direction) of the corresponding shield terminal 9, and the outer circumference of the first packing 11 contacts with the internal circumference of the corresponding tubular housing part 15.

Each second packing 13 is formed of a non-conductive (insulating) material such as rubber in a tubular shape. The second packing 13 fits tightly to the third section (lower end part) of the corresponding shield terminal 9 in the axial extending direction of the corresponding shield terminal 9 such that the second packing 13 gets into the inside of the third section of the shield terminal 9. The second packing 13 also fits tightly around the corresponding shield wire 7 such that the corresponding shield wire 7 passes through the inside of the second packing 13.

The extending direction of the axis (central axis) of the second packing 13 corresponds to the vertical direction. The central axis of the corresponding shield wire 7 nearly corresponds to that of the second packing 13. The internal circumference of the second packing 13 contacts with the corresponding shield wire 7, and the outer circumference of the second packing 13 contacts with the inner side of the third section (lower end part) of the corresponding shield terminal 9 in the axial extending direction thereof.

At the contact portions of the first packing 11, in order to eliminate a gap between the first packing 11 and the shield terminal 9 and a gap between the first packing 11 and the tubular housing part 15, the first packing 11 adheres closely to the shield terminal 9 and the tubular housing part 15 for sealing. At the contact portions of the second packing 13, in order to eliminate a gap between the second packing 13 and the shield wire 7 and a gap between the second packing 13 and the shield terminal 9, the second packing 13 adheres closely to the shield wire 7 and the shield terminal 9 for sealing.

The fitting by the first packing 11 and the second packing 13 enables to seal a joint portion 29 of the shield terminal 9 and the braided shield wire 25, which is positioned inside the tubular housing part 15.

As described above, the connector 3 is to be installed and used in another onboard apparatus. In a state where the connector 3 is installed in the apparatus, since the connector 3 is made waterproof, the connector 3 has no infiltration of water and the like into the inside thereof.

That is, since the apparatus engagement part (food part) 19 of the housing 5 is sealed with a packing 31 provided on the outer circumference of the food part 19, there is no infiltration of water and the like into the food part 19 from the outside. Further, since the upper end of each shield wire 7 gets into the housing 5 by, for example, insert molding, there is no infiltration of water and the like into each closed space 33 from the side of the housing 5. Furthermore, there is no infiltration of water and the like into the closed space 33 from the upper side of the closed space 33 through the housing 5 or the like in FIG. 3.

Each closed space 33 is formed by the housing body part 17, the tubular housing part 15, the shield terminal 9, the first packing 11, the second packing 13, and the shield wire 7. The closed space 33 is a space that is isolated from the outside of the housing 5. The joint portion 29 of the shield terminal 9 and the braided shield wire 25 exists within the closed space 33.

The connector 3 has a common waterproof structure for the housing 5 and each shield wire 7. The conventional connector has independent sealings for the joint portion of a shield terminal and a braided shield wire and for the connecting portion of a terminal and a core wire of a shield wire. That is, in the conventional connector, a closed space where the joint portion of the shield terminal and the braided shield wire exists and a closed space where the connecting portion of the terminal and the core wire of the shield wire exists are discontinuous and isolated.

On the other hand, since the closed space 33 of the connector 3, where the joint portion 29 of the shield terminal 9 and the braided shield wire 25 exists, is sealed by the housing 5 and the like, as described above, there is no infiltration of water and the like into the close space 33.

The connector waterproof structure 1 includes a shield shell 35. The shield shell 35 is made of a conductive material such as metal or the like, and includes tubular shield shells part 37 and 37. The shield shell 35 is mounted on the housing 5 as one body with the housing 5. The corresponding tubular housing part 15 and the corresponding shield terminal 9 get into the inside of each tubular shield shell part 37. The corresponding shield wire 7 also passes through the inside of the tubular shield shell part 37.

The third section (lower end part) of the corresponding shield terminal 9 in the axial extending direction thereof is supported by the tubular shield shell part 37.

The shield shell 35 includes the tubular shield shell parts 37 and 37, a box-shaped part 39, and a front protruding part 41.

In a state where the shield shell 35 is mounted on the housing 5, the extending direction of the axis (central axis) of each tubular shield shell part 37 corresponds to the vertical direction.

The tubular shield shell part 37 protrudes below the corresponding second packing 13 and the corresponding shield terminal 9 over the lower end of the corresponding tubular housing part 15. The protruding length of the tubular shield shell part 37 is shorter than the extending length of the corresponding shield wire 7. The central axis of the tubular shield shell part 37 nearly corresponds to the central axis of the corresponding shield wire 7.

Detailed description of the connector waterproof structure 1 will be given below.

There are two tubular housing parts 15 and 15 in a cylindrical shape, which protrude downward from the housing 5 so as to align in the lateral direction. Two shield wires 7 and 7 extend from the tubular housing parts 15 and 15, respectively. That is, two shield wires 7 and 7 extend from the housing body part 17.

The housing body part 17 includes a fuse attachment part 43. The fuse attachment part 43 is formed in a recess shape which opens rearward. The opening of the fuse attachment part 43 is covered with a cover 45. The cover 45 and a packing 47 seal the fuse attachment part 43.

There are two terminals 49 and 49 provided in the food part 19 of the connector 3. When the connector 3 is installed in the apparatus, the terminals 49 contact with corresponding terminals of the apparatus, respectively. Two terminals 49 and 49 are aligned in the lateral direction. A core wire of one of the shield wires 7 and 7 that get into the housing 5, is connected with one of the terminals 49 and 49, and a core wire of the other of the shield wires 7 and 7 that get into the housing 5, is connected with the other of the terminals 49 and 49. A fuse 51 installed in the fuse attachment part 43 is provided between the terminals 49 and 49.

The shield shell 35 is formed in a shell shape (three-dimensional shape with a predetermined thickness) and separated into a front shield shell 53 and a rear shield shell 55.

The front shield shell 53 has a shape where two members are put together, each having a semicylindrical shape. The rear shield shell 55 includes the box-shaped part 39, the front protruding part 41, and a lower protruding part 57. The lower protruding part 57 is formed in the same shape with a corresponding part of the front shield shell 53.

In a state where the shield shell 35 is mounted on the housing 5, the front shield shell 53 and the lower protruding part 57 of the rear shield shell 55 are faced to form the tubular shield shell parts 37 and 37.

The lower end of each tubular shield shell part 37 of the shield shell 35 is positioned lower than the lower end of the corresponding second packing 13 and the lower end of the corresponding shield terminal 9. The corresponding shield wire 7 passes through an opening at the lower end of the tubular shield shell part 37 of the shield shell 35 and further extends downward. The box-shaped part 39 covers the rear side of the housing 5.

At each shield wire 7, a point that is apart downward from the upper end of the shield wire 7 by a predetermined distance is defined as a first point. A point that is apart downward by a predetermined distance from the first point is defined as a second point. A point that is apart downward by a predetermined distance from the second point is defined as a third point. A point that is apart downward by a predetermined distance from the third point is defined as a fourth point.

Between the upper end and the first point of the shield wire 7, only the core wire 21 exists. Between the first point and the second point of the shield wire 7, the core wire 21 and the inner covering body 23 exist by removing the outer covering body 27 and the braided shield wire 25. Between the second point and the third point of the shield wire 7, only the outer covering body 27 is removed. In a state where the shield terminal 9 is installed in the tubular housing part 15, an upper part of the shield wire 7 that is above the fourth point gets into the housing 5. The core wire 21 that gets into the housing 5 is connected with the terminal 49, for example, through a bus bar (not shown).

It is noted that at the connector 3, the upper part above the fourth point of the shield wire 7, the bus bar, and a rear part of the terminal 49 are embedded in the housing 5 by insert molding and formed as one body with the housing 5. However, without limited to the above-described method, the upper part above the fourth point of the shield wire 7, the bus bar, the rear part of the terminal 49 may get into the housing 5 for installation by a method other than the insert molding. For example, in a case where the housing 5 has a structure of a plurality of separate components, the upper part above the fourth point of the shield wire 7, the bus bar, the rear part of the terminal 49 may be installed in the housing 5 by assembling the plurality of separate components (pre-molded components).

Each shield terminal 9 includes a large-diameter part 59, a middle-diameter part 61, and a small-diameter part 63. The large-diameter part 59 and the middle-diameter part 61 are connected with each other by a disc-shaped linking part 65. The middle-diameter part 61 and the small-diameter part 63 are connected with each other by a disc-shaped linking part 67. The thickness of the shield terminal 9 is thinner than that of the tubular housing part 15.

The large-diameter part 59 is positioned on the lower part of the shield terminal 9. The small-diameter part 63 is positioned on the upper part of the shield terminal 9. The middle-diameter part 61 is positioned between the large-diameter part 59 and the small-diameter part 63. The middle-diameter part 61 and the small-diameter part 63 are positioned within the tubular housing part 15 in the vertical direction. The large-diameter part 59 is positioned outside the tubular housing part 15 and below the tubular housing part 15.

The outer circumference of the large-diameter part 59 is slightly larger than that of the tubular housing part 15. The outer circumference of the middle-diameter part 61 is smaller than that of the tubular housing part 15. The internal circumference of the middle-diameter part 61 is larger than the outer circumference of the outer covering body 27 of the shield wire 7. The internal circumference of the small-diameter part 63 is smaller than that of the middle-diameter part 61, and nearly equal to the outer circumference of the braided shield wire 25 of the shield wire 7.

The linking part 65 abuts on the lower end of the tubular housing part 15. This prevents the shield terminal 9 from moving upward.

The internal circumference of the small-diameter part 63 contacts with the braided shield wire 25. The braided shield wire 25 is folded down at the upper end of the small-diameter part 63 and contacts with the outer circumference of the small-diameter part 63 so as to surround the small-diameter part 63. The braided shield wire 25 that surrounds the small-diameter part 63 is surrounded by a shield pipe 69. By fastening the braided shield wire 25 tightly by the shield pipe 69, the small-diameter part 63, the braided shield wire 25, and the shield pipe 69 are united.

The third point (the upper end of the outer covering body 27) of the shield wire 7 in the vertical direction is positioned between the disc-shaped linking part 67 and the disc-shaped linking part 65.

Figure 5:
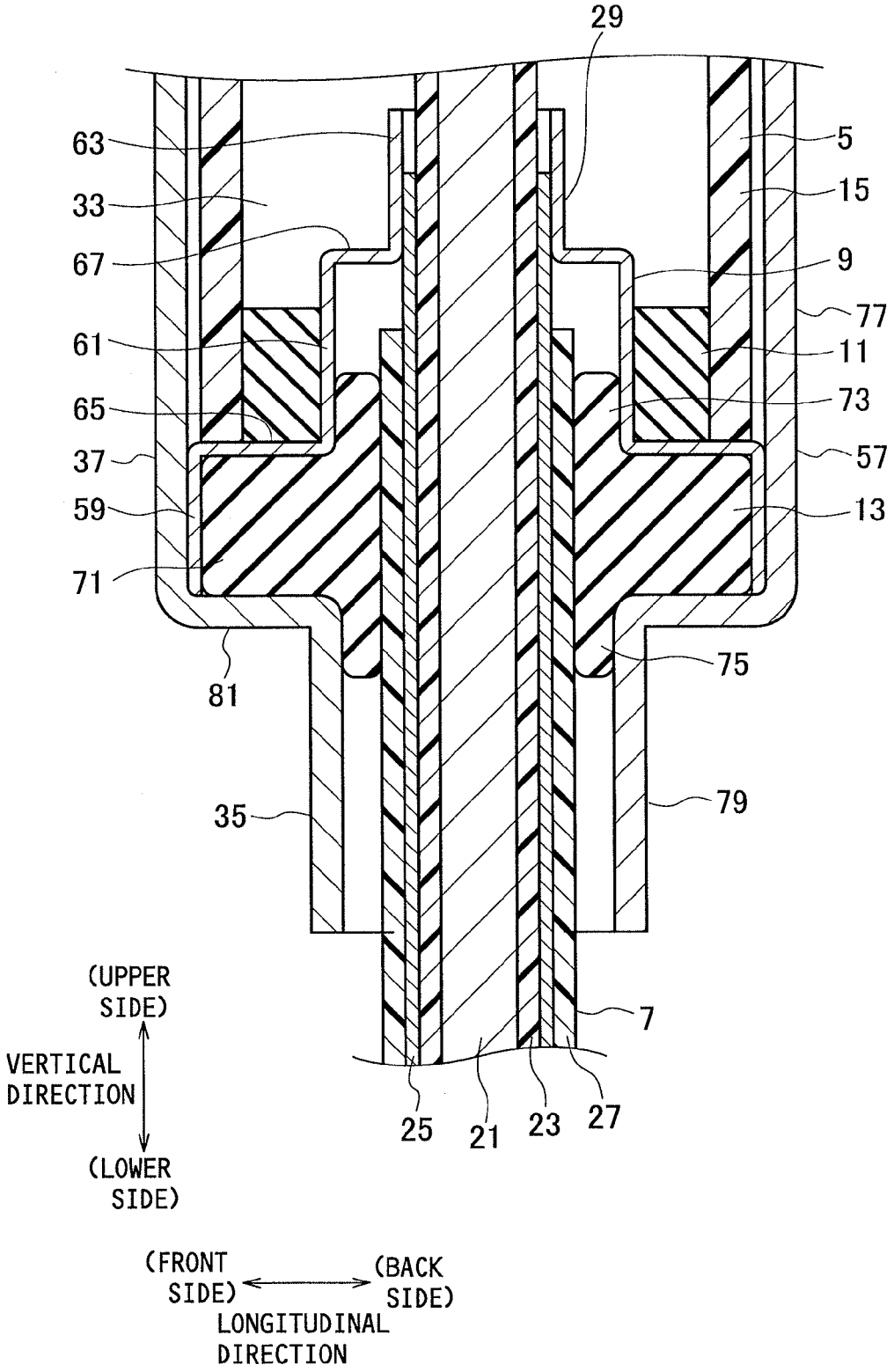
FIG. 5 is a view illustrating a variation of FIG. 4.

It is noted that, as shown in FIG. 5, the braided shield wire 25 may be merely made to contact with the internal circumference of the small-diameter part 63 of the shield terminal 9 without being folded down.

The first packing 11 is formed in a ring shape, and has a rectangular section taken along a plain including the central axis. The internal circumference of the first packing 11 contacts with the outer circumference of the middle-diameter part 61 of the shield terminal 9. The outer circumference of the first packing 11 contacts with the internal circumference of the tubular housing part 15. Thereby, sealing by the first packing 11 is done.

The second packing 13 is formed in a ring shape, and has a section of a combination of rectangles, which is taken along a plain including the central axis. The second packing 13 includes a large-diameter part 71, an upper small-diameter part 73, and a lower small-diameter part 75. The inside diameter of the large-diameter part 71, that of the upper small-diameter part 73, and that of the lower small-diameter part 75 are equal to each other. The internal circumference of the large-diameter 71, that of the upper small-diameter part 73, and that of the lower small-diameter part 75 contact with the shield wire 7 (outer covering body 27). Thereby, sealing by the second packing 13 is done.

The outer diameter of the upper small-diameter 73 and that of the lower small-diameter part 75 are smaller than the outer diameter of the large-diameter part 71. The outer circumference of the upper small-diameter part 73 contacts with the internal circumference of the middle-diameter part 61 of the shield terminal 9.

The outer circumference of the large-diameter part 71 contacts with the internal circumference of the large-diameter part 59 of the shield terminal 9. Thereby, sealing by the second packing 13 is done. The upper end of the large-diameter part 71 contacts with the linking part 65 of the shield terminal 9, or is slightly apart therefrom. In the vertical direction, the lower end of the large-diameter part 71 nearly corresponds to the lower end of the shield terminal 9.

Each tubular shield shell part 37 includes a large-diameter part 77 and a small-diameter part 79. The large-diameter part 77 and the small-diameter part 79 are connected with each other by a disc-shaped linking part 81. The small-diameter part 79 is positioned below the large-diameter part 77. As shown in FIG. 4, the tubular housing part 15, the shield terminal 9, the first packing 11, the large-diameter part 71 of the second packing 13, and the upper small-diameter part 73 of the second packing 13 exit within the large-diameter part 77 of the tubular shield shell part 37. The large-diameter part 59 of the shield terminal 9 is fitted tightly in the large-diameter part 77 of the tubular shield shell part 37. This prevents the shield terminal 9 and the like, from moving in the radial direction thereof.

The lower small-diameter part 75 of the second packing 13 gets into the inside of the small-diameter part 79 of the tubular shield shell part 37. The outer circumference of the lower small-diameter part 75 contacts with the internal circumference of the small-diameter part 79.

The lower end of the shield terminal 9 and that of the second packing 13 contact with the linking part 81 of the tubular shield shell part 37. This prevents the shield terminal 9, the second packing 13 and the like, from moving downward.

In the connector 3, a gap between the middle-diameter part 61 of the shield terminal 9 and the first packing 11 is sealed, a gap between the tubular housing 15 and the first packing 11 is sealed, a gap between the large-diameter part 59 of the shield terminal 9 and the second packing 13 is sealed, a gap between the outer covering body 27 of the shield wire 7 and the second packing 13 is sealed, and the upper part of the tubular housing part 15 is sealed by the housing body part 17. This structure prevents the infiltration of water and the like, into the closed space 33 from the outside where the joint portion of the braided shield wire 25 of the shield wire 7 and the small-diameter part 63 of the shield terminal 9 exists.

Figure 1:
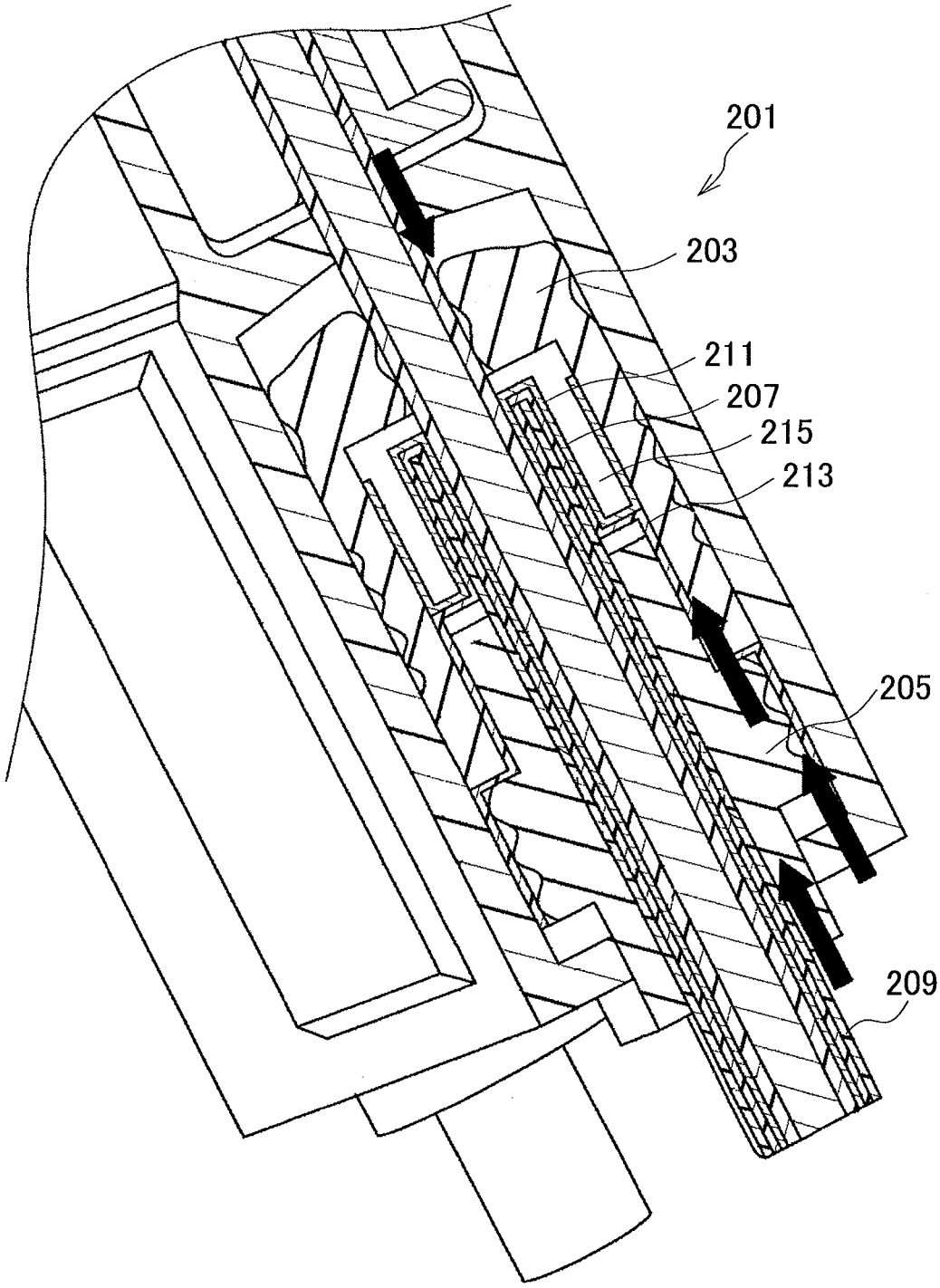
FIG. 1 PRIOR ART
FIG. 1 is a view illustrating a conventional waterproof structure for a connector.

According to the connector waterproof structure 1, since there is no conventional hollow part 215 (refer to FIG. 1) with the first packing 1 and the second packing 13, it enhances the waterproof performance of the first packing 11 and the second packing 13. Specifically, the internal circumference of the first packing 11 contacts with the shield terminal 9 that has a high degree of rigidity, and the internal circumference of the second packing 13 contacts with the shield wire 7 that has a high degree of rigidity.

According to the connector waterproof structure 1, the joint portion 29 of the shield terminal 9 and the braided shield wire 25 is accommodated within the tubular housing part 15, the outer circumference of the first packing 11 contacts with the tubular housing part 15 having high rigidity, the internal circumference of the first packing 11 contacts with the shield terminal 9 having high rigidity, and the first packing 11 is supported by the tubular housing 15. This structure enhances the sealing performance for the joint portion 29 of the shield terminal 9 and the braided shield wire 25.

According to the connector waterproof structure 1, since the sealing by use of the first packing 11 and the second packing 13 is provided only on one end of the shield wire 7 in the extending direction, the length of sealing is reduced.

According to the connector waterproof structure 1, since a part of the shield wire 7, which protrudes from the tubular housing part 15 to the other end of the shield wire 7 in the vertical direction, is supported to the tubular shield shell part 37 by means of the second packing 13 and the shield terminal 9, even in a case where bending moment is applied on the shield wire 7, the shield wire 7 is not hardly bended and thereby it is possible to suppress the lowering of the waterproof performance.

What is claimed is:

1. A waterproof structure for a connector comprising:

a housing that has a tubular housing part;

a shield wire that has one end thereof getting into the housing through the tubular housing part and the other end thereof extending from the housing;

a shield terminal that has a first section, a second section, and a third section, the first section and the second section getting into the tubular housing part such that the shield wire passes through the inside of the shield terminal, the first section jointing with a braided shield wire of the shield wire, and the third section protruding from the tubular housing part;

a tubular first packing that fits tightly around the second section of the shield terminal such that the second section of the shield terminal gets into the inside of the first packing, and fits tightly to the tubular housing part such that the first packing gets into the inside of the tubular housing part; and a tubular second packing that fits tightly to the third section of the shield terminal such that the second packing gets into the inside of the third section of the shield terminal, and fits tightly around the shield wire such that the shield wire passes through the inside of the second packing.

2. The waterproof structure for a connector according to claim 1, further comprising a shield shell that has a tubular shield shell part, wherein the tubular housing part and the shield terminal get into the inside of the tubular shield shell, the shield shell is mounted on the housing such that the shield wire passes through the inside of the tubular shield shell, and the third section of the shield terminal is supported by the tubular shield shell.

* * * * *